US009909421B2

(12) United States Patent
Staskowiak et al.

(10) Patent No.: US 9,909,421 B2
(45) Date of Patent: Mar. 6, 2018

(54) MIXING SYSTEM FOR AN EXHAUST GASES AFTER-TREATMENT ARRANGEMENT

(75) Inventors: Daniel Staskowiak, Saint Denis les Bourgs (FR); Fabien Lacroix, Dardilly (FR); Solinne Moretti, Lyons (FR)

(73) Assignee: Volvo Truck Corporation, Göteborg (SE)

( * ) Notice: Subject to any disclaimer, the term of this patent is extended or adjusted under 35 U.S.C. 154(b) by 748 days.

(21) Appl. No.: 13/516,251

(22) PCT Filed: Dec. 18, 2009

(86) PCT No.: PCT/IB2009/008008

§ 371 (c)(1),
(2), (4) Date: Oct. 15, 2012

(87) PCT Pub. No.: WO2011/073717

PCT Pub. Date: Jun. 23, 2011

(65) Prior Publication Data

US 2013/0170973 A1 Jul. 4, 2013

(51) Int. Cl.
*F01N 3/00* (2006.01)
*F01D 5/00* (2006.01)
(Continued)

(52) U.S. Cl.
CPC ..... *F01D 5/00* (2013.01); *B01F 3/04049* (2013.01); *B01F 5/0473* (2013.01);
(Continued)

(58) Field of Classification Search
CPC .. B01F 5/0616; B01F 5/0473; F01N 2240/20; F01N 3/2892; F01D 5/00
(Continued)

(56) References Cited

U.S. PATENT DOCUMENTS 4,929,088 A * 5/1990 Smith ..... 366/337
5,058,381 A * 10/1991 Christenson et al. ..... 60/299
(Continued)

FOREIGN PATENT DOCUMENTS

DE 19839754 A1 3/2000
DE 202006017848 U1 3/2007
(Continued)

OTHER PUBLICATIONS

International Search Report (Sep. 10, 2010) for corresponding International Application PCT/IB2009/008008.

*Primary Examiner* — Mark Laurenzi
*Assistant Examiner* — Jason Sheppard
(74) *Attorney, Agent, or Firm* — WRB-IP LLP

(57) ABSTRACT

A mixing system includes a pipe having a longitudinal axis, in which exhaust gases can flow in a flow direction, a nozzle designed to inject a fluid inside the pipe from an injection inlet arranged in the pipe wall, according to an injection direction, a first mixing device positioned inside the pipe upstream from the injection inlet, the first mixing device including a peripheral portion including blades capable of creating a peripheral swirl along the pipe wall, and a central portion designed to create substantially no turbulence, and a second mixing device positioned inside the pipe downstream from the injection inlet, the second mixing device including a central portion including blades capable of creating a swirl inside the pipe.

17 Claims, 3 Drawing Sheets

(51) Int. Cl.

| | |
|---|---|
| ***B01F 3/04*** | (2006.01) |
| ***B01F 5/04*** | (2006.01) |
| ***B01F 5/06*** | (2006.01) |
| ***F01N 3/28*** | (2006.01) |

(52) U.S. Cl.
CPC ..... *B01F 5/0616* (2013.01); *F01N 3/2892* (2013.01); *F01N 2240/20* (2013.01)

(58) Field of Classification Search
USPC ..... 60/295; 366/336–338
See application file for complete search history.

(56) References Cited

U.S. PATENT DOCUMENTS

| | | | | |
|---|---|---|---|---|
| 5,309,946 | A * | 5/1994 | Ligneul | 138/39 |
| 7,533,520 | B2 * | 5/2009 | Cheng et al. | 60/286 |
| 7,797,937 | B2 * | 9/2010 | Endicott | F02M 29/06 123/306 |
| 7,908,845 | B2 * | 3/2011 | Brown et al. | 60/286 |
| 2009/0019843 | A1 | 1/2009 | Levin et al. | |
| 2010/0107617 | A1 * | 5/2010 | Kaiser | F01N 3/2066 60/324 |

FOREIGN PATENT DOCUMENTS

| | | | | |
|---|---|---|---|---|
| DE | 102007012790 | A1 * | 9/2008 | B01F 3/04049 |
| EP | 1712753 | A2 | 10/2006 | |
| FR | 2937692 | A3 * | 4/2010 | B01F 3/04049 |
| WO | 2008023856 | A1 | 8/2006 | |
| WO | WO 2011135161 | A1 * | 11/2011 | F01N 3/2066 |

* cited by examiner

MIXING SYSTEM FOR AN EXHAUST GASES AFTER-TREATMENT ARRANGEMENT

BACKGROUND AND SUMMARY

The present invention relates to a mixing system for an exhaust gases after-treatment arrangement, for example in an exhaust gas pipe. Said system is especially designed to improve the mixing of a fluid with the exhaust gases of a thermal engine, while also preventing the solid deposits of said fluid on the pipe wall. The present invention can be used for example in an exhaust pipe of a diesel engine wherein an aqueous solution of urea is injected in view of an after-treatment of the exhaust gases.

Exhaust gases formed in the combustion of fuel in an internal combustion engine may contain a proportion of undesirable substances such as nitrogen oxides (NOx), carbon monoxide (CO), un-burnt hydrocarbons (HC), soot, etc. . .

To reduce air pollution, vehicles are therefore equipped with various after-treatment systems that deal with undesirable substances in exhaust gases.

A common exhaust gases after-treatment system is a so called selective catalytic reduction (SCR) system. Exhaust gases wherein ammonia is added as a reducer is treated in a specific catalytic converter where nitrogen oxides are converted into water and nitrogen which are both non toxic substances. Ammonia is introduced in the form of urea in an aqueous solution from which ammonia is obtained through hydrolysis. Urea is usually nebulised in the exhaust gas upstream of the catalytic converter. To this end, a urea injection nozzle is fitted on the exhaust line upstream from the catalytic converter.

A problem with this type of exhaust gases treatment is that, before it has transformed into ammonia, urea can crystallize. In concrete terms, the aqueous solution of urea which is sprayed through the nozzle inside the exhaust pipe, according to a direction which is angled with respect to the exhaust gases flow direction, tends to form a solid deposit on the exhaust pipe wall, on the internal side thereof, for example opposite of the injection point. The consequence is that the cross section of the exhaust pipe is progressively reduced, which makes the engine efficiency decrease and which can seriously impair the engine operation in the long term.

Many prior art devices are not fully effective since they do not make it possible to achieve the complete chemical decomposition of liquid urea into gases and/or a satisfactory mixing of urea with exhaust gases.

One conventional device, generally referred to as a "swirl box", makes it possible to achieve both above mentioned results to some extent. However, such a swirl box has several drawbacks. First of all, it needs to be long enough to allow the substantially complete chemical decomposition of urea and therefore it may be quite bulky. Moreover, when it has to be installed, it generally requires design adjustments of the surrounding parts. Besides, such a swirl box provokes backpressure and is quite expensive. Anyway, known swirl box designs do not always prevent effectively solid deposits.

It therefore appears that there is room for improvement in the systems for injecting a fluid in a pipe carrying exhaust gases and for mixing them.

It is desirable to provide an improved mixing system which can overcome the drawbacks encountered in conventional mixing systems, and particularly which prevents or at least limits the injected fluid from forming a deposit onto the pipe surface while also promoting a satisfactory mixing between said injected fluid and the exhaust gases.

For this purpose, the invention concerns, according to an aspect thereof, a mixing system for an exhaust gases after-treatment arrangement, said mixing system comprising:

- a pipe having a longitudinal axis, in which exhaust gases can flow in a flow direction (FD);
- a nozzle designed to inject a fluid inside the pipe from an injection inlet arranged in the pipe wall, according to an injection direction (ID);
- a first mixing device positioned inside the pipe upstream from the injection inlet;

wherein the first mixing device includes a peripheral portion comprising blades capable of creating a peripheral swirl along the pipe wall, and a central portion designed to create substantially no turbulence or a turbulence which is negligible compared to the turbulence created by the peripheral portion, and wherein the mixing system further comprises a second mixing device positioned inside the pipe downstream from the injection inlet, said second mixing device including a central portion comprising blades capable of creating a swirl inside the pipe.

By creating a peripheral swirl, the first mixing device, which is located upstream from the injection inlet, prevents the fluid from wetting the pipe wall, in particular but not exclusively opposite the injection inlet, or at least greatly reduces this wetting effect. As a result, solid deposits are avoided or highly limited.

The first mixing device is designed to generate turbulence mostly in the peripheral part of the pipe inner volume. For example, immediately downstream from the first mixing device, the turbulent kinetic energy of the fluid flowing in the pipe is at least ten times higher in the peripheral part than in the central part of the pipe inner volume. Another advantage of having substantially no turbulence created by the central portion of the first mixing device is that it limits backpressure. Indeed, the creation of a peripheral swirl is sufficient to achieve the aim of said first mixing device, i.e. avoiding deposits on the pipe inside wall.

Furthermore, the second mixing device, which is located downstream from the injection inlet, has a double function. Indeed, it creates a central swirl in the pipe, which complements the swirl created by the first mixing device, and furthermore helps breaking the fluid drops. As a result, the second mixing device promotes the mixing between the fluid (or the gases obtained by the decomposition of said fluid) and the exhaust gases and, in case the fluid is an aqueous solution of urea, improves the decomposition of liquid urea into gases.

With this arrangement, the mixing system according to the invention is much more effective than prior art systems in terms of evaporation, decomposition and mixing, and makes it possible to greatly reduce the solid deposits on the pipe inside surface.

Advantageously, the central portion of the first mixing device is substantially devoid of blades. Preferably, said central portion is devoid of any element, except possible stiffening means which generate substantially no turbulence.

In an implementation of the invention, the peripheral portion of the first mixing device forms a ring having a width, measured along a radial direction, which represents between around 30% and around 50% of the first mixing device radius.

According to an embodiment of the invention, the first mixing device comprises:

a substantially cylindrical sleeve having an axis and substantially forming a border between the peripheral portion and the central portion of said first mixing device;

a plurality of spoke members extending from the area surrounding the sleeve axis, and beyond said sleeve, the ends of the spoke members being in contact with the pipe wall so that, when the first mixing device is positioned inside the pipe, the sleeve axis substantially coincides with the pipe axis.

Preferably, the peripheral portion of the first mixing device can comprise an outer ring of substantially identical outer blades capable of creating a peripheral swirl and an inner ring of substantially identical inner blades capable of deflecting the exhaust gases outwardly towards the outer ring of blades. The inner blades thus have a centrifugal effect and also contributes to the creation of the peripheral swirl. Providing two sets of blades also makes it possible to generate more turbulence, which enhances the mixing between the fluid and the exhaust gases. The inner blades preferably have a shape different from the shape of the outer blades.

For example, each outer blade extends from a downstream radial edge of a spoke member towards the downstream direction, said outer blade being further inclined towards the adjacent spoke member, and all outer blades being inclined similarly.

Each inner blade can extend from a downstream edge of the sleeve towards the downstream direction, said inner blade being further inclined outwardly. Thus, the inner blades all together form a kind of a cone frustrum which diverges towards the downstream direction. Preferably, each inner blade is further obliquely tapered from the sleeve towards its free end and therefore arranged to create a swirl in the same rotating direction than the outer blades.

As regards the second mixing device, it includes a peripheral portion which is preferably substantially devoid of blades. Thus, the pressure loss is limited. However, in said peripheral portion, the second mixing device can be provided with means designed to allow the positioning of said device inside the pipe.

According to a preferred implementation of an aspect of the invention, the blades of the peripheral portion of the first mixing device and the blades of the central portion of the second mixing device are oriented oppositely. By creating two opposite swirls, this arrangement improves the mixing of the fluid and gases inside the pipe and the homogenization of said mixture.

The second mixing device can comprise:

a substantially cylindrical sleeve having an axis and substantially forming a border between the peripheral portion and the central portion of said second mixing device;

a plurality of spoke members extending from the area surrounding the sleeve axis beyond said sleeve, the ends of the spoke members being in contact with the pipe wall so that, when the first mixing device is positioned inside the pipe, the sleeve axis substantially coincides with the pipe axis.

The central portion of the second mixing device preferably comprises an outer ring of substantially identical outer blades and an inner ring of substantially identical inner blades. By providing two sets of different blades, the turbulence obtained is greater.

For example, each inner blade extends from a downstream radial edge of a spoke member towards the downstream direction, said inner blade being further inclined towards the adjacent spoke member, and all inner blades being inclined similarly.

Each outer blade can extend from a downstream edge of the sleeve towards the downstream direction, said outer blade being further inclined outwardly. Preferably, each outer blade is further obliquely tapered from the sleeve towards its free end and therefore arranged to create a swirl in the same rotating direction than the inner blades.

It can be envisaged that the central portions of the first and second mixers substantially have the same radiuses. Therefore, when seen along the pipe axis, the successive first and second mixing devices seem superimposed and look like a single structure having blades substantially on its entire cross section.

A specific application of the invention is the treatment of NOx in exhaust gases. In that case, said pipe is an exhaust pipe of a diesel engine and said second fluid is an aqueous solution of urea.

The invention makes it possible to obtain a satisfactory mixing between exhaust gases and urea and then, further downstream, between NOx and ammonia when urea has broken down. Therefore, it is possible to effectively reduce the NOx compounds and to achieve considerably lower NOx emissions. At the same time, the invention effectively prevents urea that has not broken down into ammonia yet from making a deposit on the pipe, in particular opposite its injection pipe, thereby increasing the service life of said exhaust pipe.

These and other features and advantages will become apparent upon reading the following description in view of the drawing attached hereto representing, as non-limiting examples, embodiments of a vehicle according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

DETAILED DESCRIPTION

Figure 1:
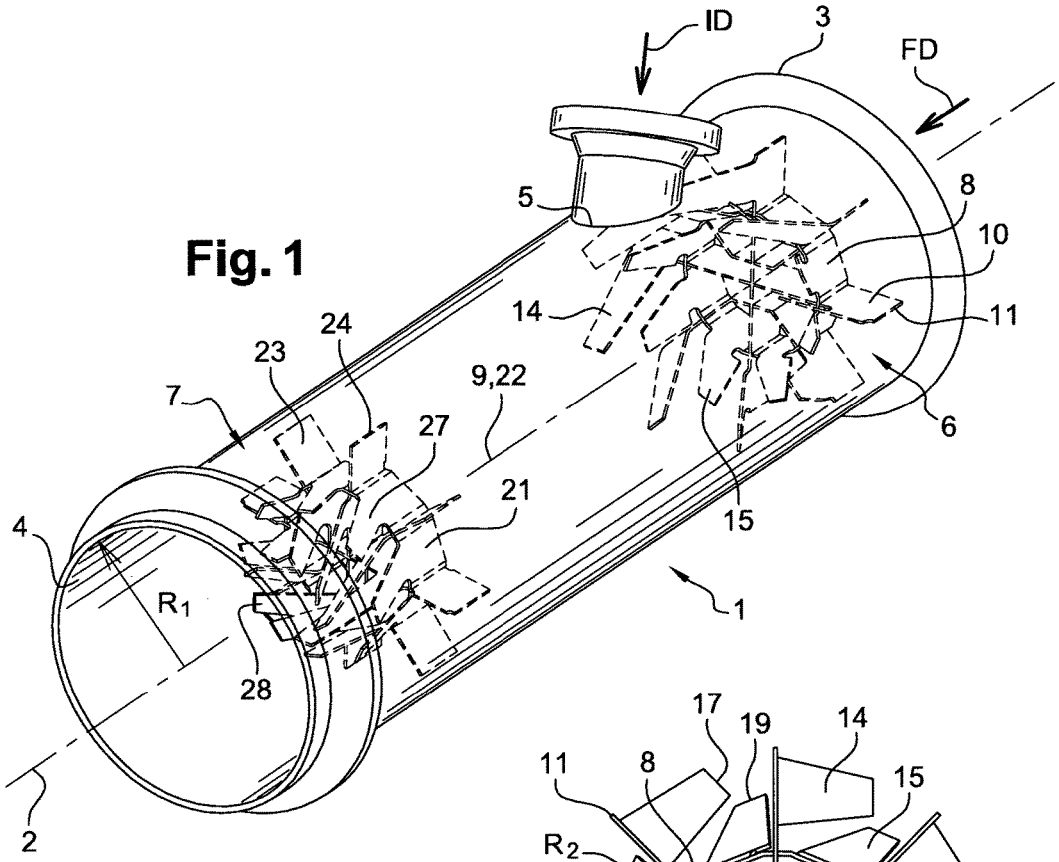
FIG. 1 is a perspective view of an exhaust pipe comprising a nozzle for injecting a fluid, and in which are positioned a first—upstream—mixing device and a second—downstream—mixing device.

FIG. 1 shows a pipe 1 which is an exhaust pipe of an engine, typically a diesel engine. Only a straight portion of pipe 1 is illustrated, however pipe 1 can include several bends, upstream and/or downstream from said straight portion. The pipe 1 has a central axis 2 which extends longitudinally in the straight portion. The pipe 1 has a radius R1.

The engine exhaust gases can flow inside pipe 1 from its inlet 3, on the engine side, towards its outlet 4, where said gases are directed towards a non depicted catalytic converter before being released into the atmosphere. The general flow direction FD of exhaust gases is substantially parallel to the pipe central axis 2 (upstream from any mixing device designed to generate turbulence). The words "upstream" and "downstream" are used with respect to said flow direction FD. The word "inner" refers to a part located closer to the pipe axis 2 as opposed to the word "outer".

An injection inlet 5 is provided in the pipe wall. A nozzle (not shown) arranged in said injection inlet 5 is designed to inject a fluid inside pipe 1 through injection inlet 5, according to an injection direction ID, thereby forming a spray. Said injection direction ID is roughly oriented downstream, while also being angled with respect to said flow direction FD. For example, the corresponding angle may be around 30°-75°. In the embodiments illustrated, the fluid is an aqueous solution of urea. The injection direction ID is the direction along which the fluid is injected at the nozzle outlet, whatever the direction along which said fluid flows further downstream, particularly if it is drawn by the exhaust gases.

As shown on FIG. 1, a first mixing device 6 is fastened inside pipe 1, upstream from the injection inlet 5 and close to it. A second mixing device 7 is fastened inside pipe 1, downstream from the injection inlet 5. The distance between the first mixing device 6 and the injection inlet 5 is smaller than the distance between the injection inlet 5 and the second mixing device 7. Both mixing devices 6, 7 can be made of stainless steel.

Figure 2:
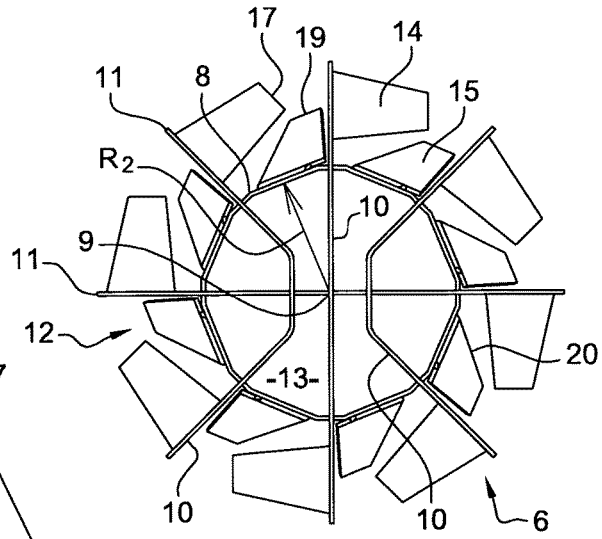
FIGS. 2 and 3 are, respectively, an axial and a perspective view of the first mixing device.
Figure 3:
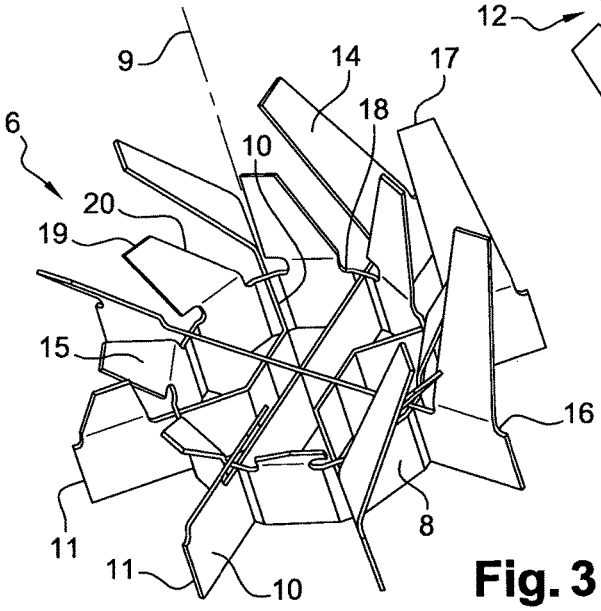

The first mixing device 6 is illustrated on FIGS. 2 and 3. It comprises a substantially cylindrical sleeve 8 having an axis 9, a radius R2 and a plurality of spoke members 10 extending substantially along a radial direction from the area surrounding the sleeve axis 9 beyond said sleeve 8. In the illustrated embodiment, the first mixing device 6 comprises eight spoke members 10. The spokes are angularly regularly spaced around the sleeve axis 9. The spoke members 10 are substantially flat and parallel to the flow direction FD. When the first mixing device 6 is positioned inside the pipe 1, the outward ends 11 of the spoke members 10 are in contact with the inner surface of the pipe wall and ensure that the sleeve axis 9 substantially coincides with the pipe axis 2.

The sleeve 8 substantially forms a border between a peripheral portion 12 and a central portion 13 of said first mixing device 6. The peripheral portion 12 forms a ring having a width between around 30% and around 50% of the first mixing device radius, i.e. of the pipe radius R1.

The central portion 13 is substantially devoid of any elements, except the central part of the spoke members 10. In particular, the central portion 13 does not contain any blades. Thus, the central portion 13 creates substantially no turbulence or a turbulence which is negligible compared to the turbulence created by the peripheral portion 12.

The peripheral portion 12 comprises an outer ring of substantially identical outer blades 14 and an inner ring of substantially identical inner blades 15. In the illustrated embodiment, the outer blades 14 are longer than the inner blades 15. Contrary to the spokes 10 and to the sleeve, the blades 14, 15 are angled with respect to the general flow direction FD.

One outer blade 14 extends from each spoke member 10, from a downstream radial edge 16 thereof, towards the downstream direction. Moreover, each outer blade 14 is inclined, with respect to the plane in which the spoke member 10 extends, towards the adjacent spoke member 10. All outer blades 14 are inclined similarly, and therefore are capable of creating a peripheral swirl along the pipe wall, as shown on FIG. 8. When looking downstream, the peripheral swirl rotates clockwise. However, the opposite configuration is possible. Preferably, each outer blade 14 is tapered from the spoke member 10 towards its free end 17.

Besides, one inner blade 15 extends from the sleeve 8 between two successive outer blades 14. Each inner blade 15 extends from a downstream edge 18 of the sleeve 8 towards the downstream direction. The inner blades 15 are inclined outwardly so that they are capable of deflecting the exhaust gases outwardly towards the outer ring of outer blades 14. Furthermore; the inner blades 15 are tapered from the sleeve 8 towards their free ends 19 and have an inclined edge 20, thereby being designed to create a swirl in the same rotating direction than the outer blades 14.

Figure 4:
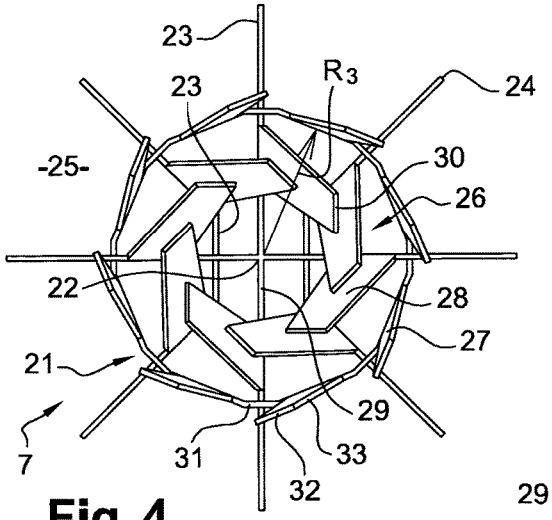
FIGS. 4 and 5 are, respectively, an axial and a perspective view of the second mixing device.
Figure 5:
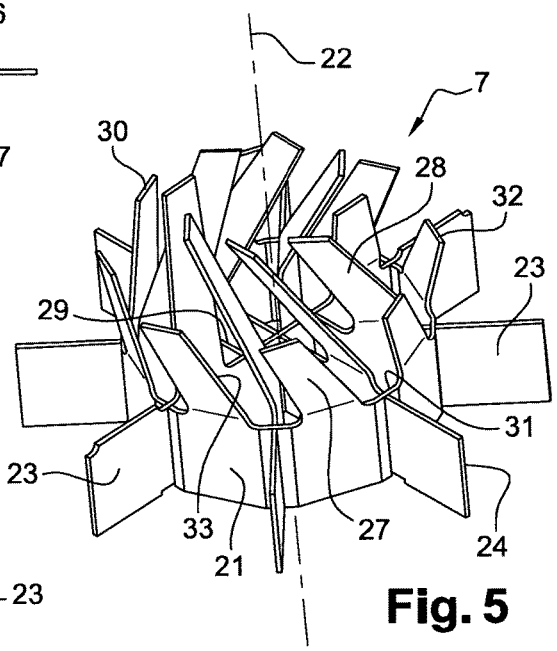

The second mixing device 7 is illustrated on FIGS. 4 and 5. It comprises a substantially cylindrical sleeve 21 having an axis 22 and a radius R3 which is substantially identical to the radius R2 of the sleeve 8 of the first mixing device 6. The second mixing device 7 also comprises a plurality of spoke members 23 extending from the area surrounding the sleeve axis 22 beyond said sleeve 21. In the illustrated embodiment, the second mixing device 7 comprises eight spoke members 23. The spoke members 23 are substantially flat and parallel to the flow direction FD. When the second mixing device 7 is positioned inside the pipe 1, the ends 24 of the spoke members 23 are on contact with the inner surface of the pipe wall and ensure that the sleeve axis 22 substantially coincides with the pipe axis 2.

The sleeve 23 substantially forms a border between a peripheral portion 25 and a central portion 26 of said second mixing device 7. The peripheral portion 25 forms a ring having a width between around 30% and around 50% of the first mixing device radius, i.e. of the pipe radius R1.

The peripheral portion 25 is substantially devoid of any elements, except the end parts of the spoke members 23. In particular, the peripheral portion 25 does not contain any blades.

The central portion 26 comprises an outer ring of substantially identical outer blades 27 and an inner ring of substantially identical inner blades 28. In the illustrated embodiment, the inner blades 28 are longer than the outer blades 27.

One inner blade 28 extends from each spoke member 23, from a downstream radial edge 29 thereof, towards the downstream direction. Moreover, each inner blade 28 is inclined, with respect to the plane in which the spoke member 23 extends, towards the adjacent spoke member 23. All inner blades 28 are inclined similarly, and therefore are capable of creating a swirl inside the pipe 1, around and close to the axis 2, as shown on FIG. 8. Said blades 28 have an orientation which is opposite the orientation of the blades 14, 15 of the first mixing device 6, in order to produce a counter-rotating flow. Therefore, in the illustrated embodiment, when looking downstream, the central swirl rotates anticlockwise. Preferably, each inner blade 28 is tapered from the spoke member 23 towards its free end 30.

Besides, one outer blade 27 extends from the sleeve 21 between two successive inner blades 28. Each outer blade 27 extends from a downstream edge 31 of the sleeve 21 towards the downstream direction. The outer blades 27 are inclined outwardly. Furthermore, the outer blades 27 are tapered from the sleeve 21 towards their free ends 32 and have an inclined edge 33, thereby being designed to create a swirl in the same rotating direction than the inner blades 28. Said blades 27 have an orientation which is opposite the orientation of the blades 14, 15 of the first mixing device 6, in order to produce a counter-rotating flow.

Figure 6:
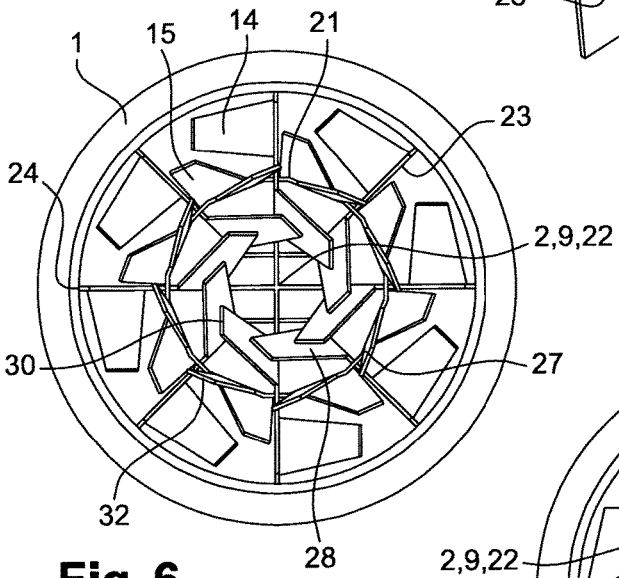
FIGS. 6 and 7 are axial views of the pipe and mixing devices, respectively when looking upstream and when looking downstream.
Figure 7:
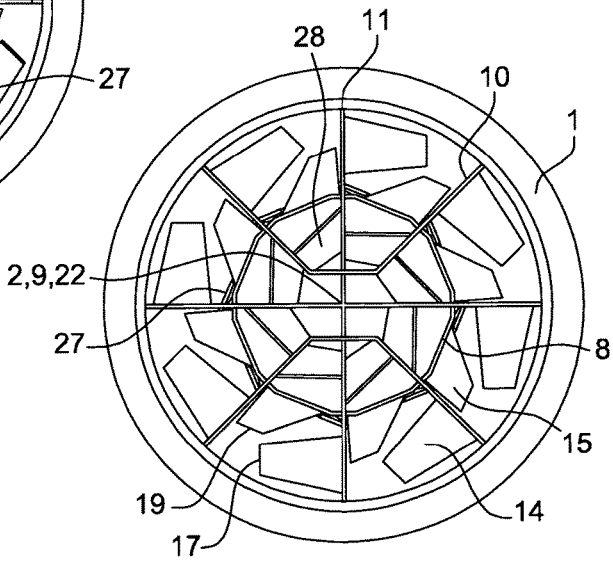

FIGS. 6 and 7 are axial views of the pipe and mixing devices 6, 7, respectively when looking upstream and when looking downstream.

As described above, the invention provides:

a first mixing device 6 having inclined blades 14, 15 in its peripheral portion 12 and substantially no blades in its central portion 13, in order to promote swirl along the walls of the exhaust pipe 1 while substantially not affecting the central part of the exhaust gas stream;

and a second mixing device 7 having blades 27, 28 mainly in its central portion 26 to promote mixing, the blades 14, 15 of the first mixing device 6 and the blades 27, 28 of the second mixing device 7 being oriented oppositely to produce counter-rotating flows.

As it can be seen from FIGS. 6 and 7, the "superimposition" of the mixing devices 6, 7 in the longitudinal direction makes the devices look like a single mixing device having blades substantially on its entire surface area. This can be achieved also by the fact that radiuses R2 and R3 are substantially equal. Such a combination of the first and the second mixing devices 6, 7 generates turbulence which improves evaporation and decomposition of the urea (injected fluid) as well as mixing of urea and ammonia with the exhaust gases.

Figure 8:
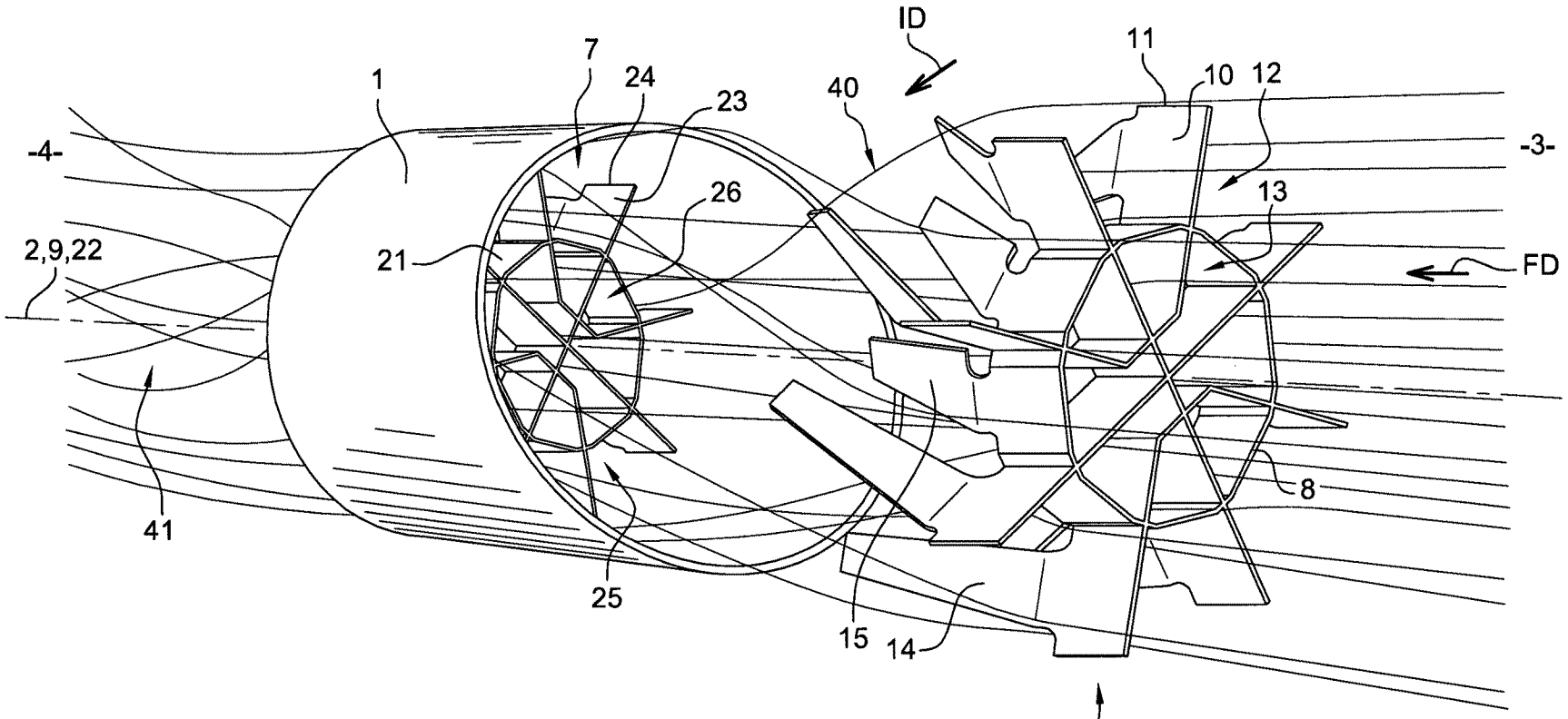
FIG. 8 is a graphical representation of the flow lines of the exhaust gases in the pipe, in the vicinity of the first and second mixing devices.

FIG. 8 shows the flow lines of the exhaust gases in the pipe.

Upstream from the first mixing device 6, the exhaust gases flow from the inlet 3 of the pipe, the flow lines being substantially parallel to the pipe axis 2.

The first mixing device 6 causes the exhaust gases located in the peripheral portion on the pipe inner volume to rotate—here clockwise—while the exhaust gases located in the central portion on the pipe inner volume are substantially not deflected and go on flowing along the pipe axis 2. As a consequence, the fluid injected according to the injection direction ID, downstream from the first mixing device 6, is prevented from wetting the inner surface of the pipe wall by virtue of the peripheral swirl 40.

Then, the second mixing device 7 generates a central swirl 41 which preferably includes most of the fluid spray and draws said fluid further downstream while also improving the mixing of said fluid with the exhaust gases.

The mixing devices 6, 7 can be adapted depending on the flow and line characteristics in order to optimize the effectiveness. Parameters such as the sleeve diameter, the number of blade rings, the number, width, length and angle of blades can be determined according to the case in question.

Moreover, the mixing devices can be easily put up in an existing pipe or can be part of a new exhaust pipe. It must be noted that, although the mixing system is best implemented in a straight pipe section, it can also be implemented in a slightly curved pipe, i.e. a pipe having a longitudinal axis which is not a strait line but which can be a two dimensional or three dimensional curb. Preferably, the pipe axis is only moderately curved in the region where the mixing system is installed.

The mixing system described here above can also be applicable in the case where the fluid to be injected is fuel, for example in view of the regeneration of a Diesel Particulate Filter arranged downstream of the mixing system.

Of course, the invention is not restricted to the embodiment described above by way of non-limiting example, but on the contrary it encompasses all embodiments thereof.

The invention claimed is:

1. A mixing system for an exhaust gases after-treatment arrangement, the mixing system comprising:

a pipe having a longitudinal axis, in which exhaust gases can flow in a flow direction; a nozzle designed to inject a fluid inside the pipe from an injection inlet arranged in the pipe wall, according to an injection direction;

a first mixing device positioned inside the pipe upstream from the injection inlet wherein the first mixing device includes a peripheral portion comprising blades arranged to create, in operating conditions, a peripheral swirl that, rotates in one direction around the longitudinal axis and along the pipe wall, and a central portion designed to create, in operating conditions, less turbulence compared to the turbulence created by the peripheral portion; and a second mixing device positioned inside the pipe downstream from the injection inlet, the second mixing device including a central portion comprising blades arranged to create, in operating conditions, a swirl inside the pipe, wherein the second mixing device includes a peripheral and annular portion which substantially devoid of blades;

wherein the first mixing device comprises a cylindrical sleeve having an axis and forming a border between the peripheral portion and the central portion of the first mixing device, and a plurality of spoke members extending from the area surrounding the sleeve axis, and beyond the sleeve, the ends of the spoke members being in contact with the pipe wall so that, when the first mixing device is positioned inside the pipe, the sleeve axis coincides with the pipe axis.

2. The mixing system according to claim 1, wherein the central portion of the first mixing device is devoid or substantially devoid of blades.

3. The mixing system according to claim 1, wherein the peripheral portion of the first mixing device forms a ring having a width between around 30% and 50% of the first mixing device radius.

4. The mixing system according to claim 1, wherein the peripheral portion of the first mixing device comprises an outer ring of identical outer blades capable of creating a peripheral swirl and an inner ring of identical inner blades capable of deflecting the exhaust gases outwardly towards the outer ring of blades.

5. The mixing system according to claim 1, wherein the peripheral portion of the first mixing device comprises an outer ring of identical outer blades capable of creating a peripheral swirl and an inner ring of identical inner blades capable of deflecting the exhaust gases outwardly towards the outer ring of blades, and each outer blade extends from a downstream radial edge of a spoke member towards the downstream direction, the outer blade being further inclined towards the adjacent spoke member, and all outer blades being inclined similarly.

6. The mixing system according to claim 1, wherein the peripheral portion of the first mixing device comprises an outer ring of identical outer blades capable of creating a peripheral swirl and an inner ring of identical inner blades capable of deflecting the exhaust gases outwardly towards the outer ring of blades, and each inner blade extends from a downstream edge of the sleeve towards the downstream direction, the inner blade being further inclined outwardly.

7. The mixing system according to claim 1, wherein the blades of the peripheral portion of the first mixing device and the blades of the central portion of the second mixing device are oriented oppositely.

8. A mixing system for an exhaust gases after-treatment arrangement, the mixing system comprising;

a pipe having a longitudinal axis, in which exhaust gases can flow in a flow direction;

a nozzle designed to inject a fluid inside the pipe from an injection inlet arranged in the pipe wall, according to an injection direction;

a first mixing device positioned inside the pipe upstream front the injection inlet wherein the first mixing device Includes a peripheral portion comprising blades arranged to create, in operating conditions, a peripheral swirl that rotates in one direction around the longitudinal axis and along the pipe wall, and a central portion designed to create, in operating conditions, less turbulence compared to the turbulence created by the peripheral portion; and a second mixing device positioned inside the pipe downstream from the injection inlet, the second mixing device including a central portion comprising blades arranged to create, in operating conditions, a swirl inside the pipe, wherein the second mixing device comprises a cylindrical sleeve having an axis and forming a border between the peripheral portion and the central portion of the second mixing device, and wherein a plurality of spoke members extends from an area surrounding an axis of the sleeve and, beyond the sleeve, ends of the spoke members are in contact with the pipe wall so that, when the second mixing device is positioned inside the pipe, the sleeve axis coincides with the pipe axis.

9. The mixing system according to claim 1, wherein the central portion of the second mixing device comprises an outer ring of identical outer blades and an inner ring of substantially identical inner blades.

10. The mixing system according to claim 8, wherein the central portion of the second mixing device comprises an outer ring of identical outer blades and an inner ring of identical inner blades, and each inner blade extends from a downstream radial edge of a spoke member towards the downstream direction, the inner blade being further inclined towards the adjacent spoke member, and all inner blades being inclined similarly.

11. The mixing system according to claim 8, wherein the central portion of the second mixing device comprises an outer ring of identical outer blades and an inner ring of identical inner blades, and each outer blade extends from a downstream edge of the sleeve towards the downstream direction, the outer blade being further inclined outwardly.

12. The mixing system according to claim 1, wherein the central portions of the first and second mixers have the same radiuses.

13. The mixing system according to claim 1, wherein the pipe is an exhaust pipe of a diesel engine and wherein the second fluid is an aqueous solution of urea.

14. The mixing system according to claim 1, wherein the peripheral and annular portion of the second mixing device forms a ring having a width greater than 30% of the second mixing device radius.

15. The mixing system according to claim 1, wherein the pipe is an exhaust pipe of a diesel engine.

16. The mixing system according to claim 1, comprising a source of an aqueous solution of urea connected to the nozzle, the nozzle being configured to inject the aqueous solution of urea from the injection inlet according to the injection direction.

17. The mixing system according to claim 1, wherein the nozzle is located downstream of a downstream-most part of the first mixing device.

* * * * *